United States Patent [19]

Schnelle et al.

[11] Patent Number: 4,552,346

[45] Date of Patent: Nov. 12, 1985

[54] OPERATING TABLE

[75] Inventors: Eberhard Schnelle; Hans-Ulrich Jung, both of Rastatt; Werner Hetzel, Ottersweier, all of Fed. Rep. of Germany

[73] Assignee: Stierlen-Maquet AG, Rastatt, Fed. Rep. of Germany

[21] Appl. No.: 494,669

[22] Filed: May 16, 1983

[30] Foreign Application Priority Data

May 14, 1982 [DE] Fed. Rep. of Germany ..... 3218328

[51] Int. Cl.[4] ..... A61G 13/00

[52] U.S. Cl. ..... 269/322; 378/209

[58] Field of Search ..... 269/322–326; 378/209

[56] References Cited

U.S. PATENT DOCUMENTS

| | | | |
|---|---|---|---|
| 3,200,416 | 8/1965 | Warrick | 269/325 X |
| 3,227,440 | 1/1966 | Scott | 269/326 |
| 3,509,876 | 5/1970 | Pilz | 378/209 X |
| 3,745,996 | 7/1973 | Rush | 378/209 X |
| 4,247,091 | 1/1981 | Glowacki et al. | 269/325 |

FOREIGN PATENT DOCUMENTS

| | | | |
|---|---|---|---|
| 640539 | 5/1962 | Canada | 269/322 |

*Primary Examiner*—Frederick R. Schmidt
*Assistant Examiner*—Steven P. Schad
*Attorney, Agent, or Firm*—McCormick, Paulding & Huber

[57] ABSTRACT

An operating table for operations on extended extremities of patients includes a frame 10, a support plate 18 and a counterbar 32 at one end of the support plate 18 for propping the patient. Two vertical receiving openings 64, in which the counterbar 32 can be selectively inserted, are arranged outwardly from the longitudinal middle plane of the support plate 18, whereby the operation field is increased for better transmission of X-rays and whereby the counterbar 32 may also be used as a groin support for a patient lying on his side. The vertical receiving openings 64 are formed in an adaptor 84 which also similarly has transversely directed receiving openings 92,94 for supplemental devices laterally attached to the end of the support plate 18 and longitudinally directed receiving openings 104,106 for supplemental plates which effect a lengthening of the support plate 18.

1 Claim, 6 Drawing Figures

OPERATING TABLE

The invention concerns an operating table according to the preamble of claim 1.

One such operating table is known from the brochure of the firm Stierlen-Maquetag AG "MAQUET 1415", October 1975. In this case a single vertical receiving opening is provided on the free end of a support arm for receiving a counterbar which is located in the longitudinal middle plane of the support plate. The counterbar is used exclusively in attending to the thigh socket and similar operations in which the patient lies flat on the support plate. In the case of thigh marrow pinning and similar procedures, in which the patient lies on his side, with the known operating table a vertical groin support is attached to the support plate, at the transition point between the support plate's end section and its head section, on which the forward upper portion of the patient's pelvis can be supported. In this case an isolated spar is used with the groin support which is pivotally connected to its lower portion and which carries an extension device at its free end. The conversion of the operating table from use in a thigh socket operation, that is, with a patient lying on his back, to use in a thigh operation in which the patient lies on his side is relatively expensive.

In the case of a bone synthesizing operation it is required that the operation field can be viewed and preferably constantly supervised by means of an X-ray apparatus such as an X-ray picture amplifier. Therefore, the support plate is made to be transmissible to X-ray beams, and the frame of the operating table is so made that the use of a proper X-ray apparatus is not hindered. This is also the reason why one portion of the support arm provided by the frame has only a small width. Nevertheless, despite this in the case of thigh socket operations it can be difficult to embrace entirely the operation field in the vertical direction because this is only displaced a small distance laterally with respect to the support arm. In the case of thigh operations the supplemental spar which is used with the groin support lies on the other side and closer to the operating field and therefore makes difficult the use of an X-ray apparatus.

The invention has as its object the economical construction of an operating table of the preceeding type so that a conversion between a pelvic operation and a thigh operation can be made in a simple way and in both cases the operating field is of easy transmissibility for picture amplifiers or other X-ray apparatus.

The object of the invention is solved by an operating table of the foregoing type having the features given in claim 1.

In the case of the operating table according to the invention the counterbar which is insertable into a vertical receiving opening is displaced laterally outwardly with respect to the longitudinal middle plane of the support plate, whereby in the case of a thigh operation with the patient lying on his back on the support plate the operating field, that is the area of the thigh, is displaced outwardly to a relatively large extent whereby the operating procedure and the X-ray procedure are made easier, moreover, in many cases the counterbar can be used, as in upper arm operations with patients lying on their sides, as a groin support, or in place of the counterbar a similarly constructed, in comparison to the counterbar, but longer groin support can be inserted into the vertical receiving opening without having to bring in laterally an isolated groin support and without a special spar being required, for in these cases a spar provided for supporting an extension apparatus can be used. Therefore, in these cases a conversion is avoided or the conversion is of a relatively limited nature involving the exchange of the counterbar for a longer pelvic support inserted in the same position.

Refinements of the invention are given in the dependant claims.

The invention is explained in more detail in the following material in connection with the drawings which illustrate an exemplary embodiment. The drawings are as follows:

DESCRIPTION OF THE PREFERRED EMBODIMENTS

Figure 1:
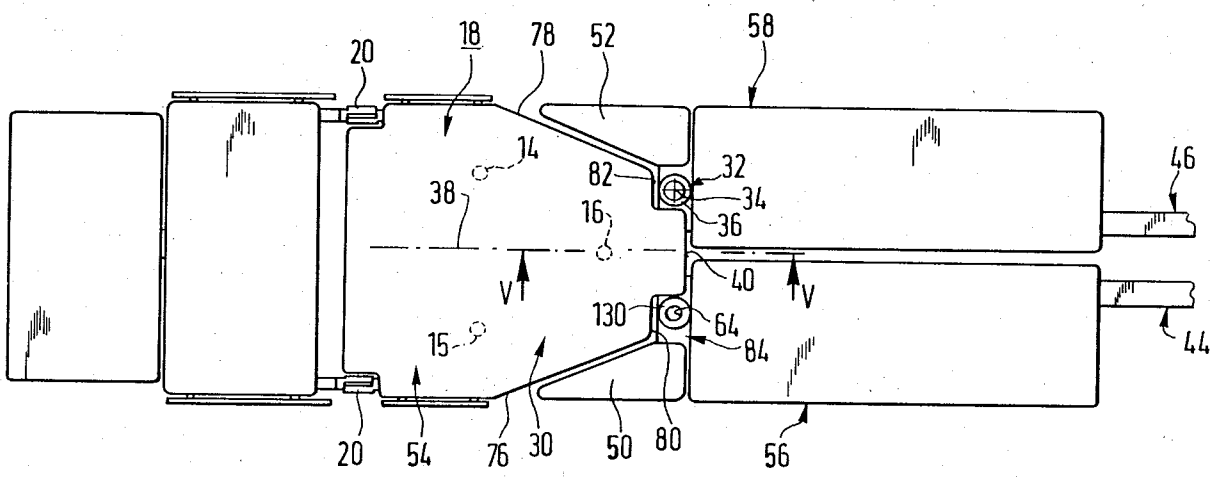
FIG. 1 is a partial plan view of an operating table according to the invention.
Figure 2:
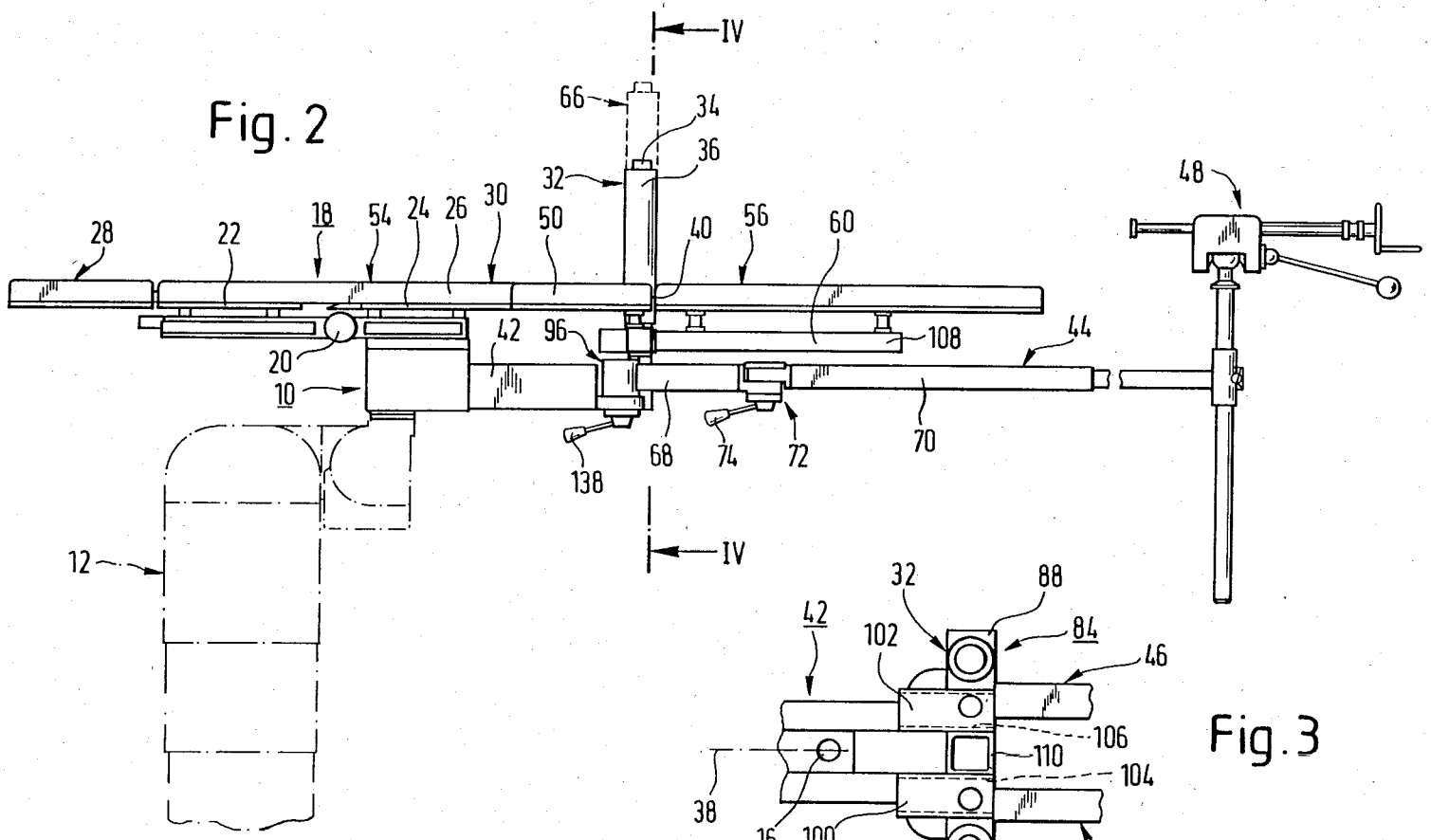
FIG. 2 is a side view of the operating table of FIG. 1.

In FIGS. 1 and 2 the illustrated operating table includes a frame 10, which can be accepted by either a fixed in place column, as shown in FIG. 2, adjustable in height and universally inclinable, or at least for transport purposes by a suitable traveling undercarriage which in turn is provided with upwardly directed pins which are received in openings indicated at 14, 15 and 16 in FIG. 1 on the underside of the frame 10. On the frame 10 is a support plate 18 for the upper body of a patient which consists of two base plates 22,24 adjustably connected to one another by pivot joints 20 and an upholstered cushion 26 overlying the plates 22 and 24, and to the left hand end of which support plate 18, as seen in FIGS. 1 and 2, a support plate 28 for the patient's head is connected. The support plate 18, which is made to allow the transmission of X-rays therethrough, includes an end section 30 serving to support the pelvis of the patient in the case of leg pinning and similar operations in which the patient lies on his back. In connection with this a vertical counterbar 32 is provided having a rigid center shaft 34 and a cushion or padding 36 which concentrically surrounds the shaft 34 and extends along it through the height of the support plate 18 and along the portion disposed above the support plate 18. Below the end section 30 is the frame 10 in the form of a support arm 42 extending along the longitudinal middle plane 38 of the support plate 18 and having a free forward end below the forward side 40 of the end section 30, with respect to which free forward end the counterbar 32 is insertably and removably held in a yet to be described way. Further, two horizontal struts 44,46 are each pivotally connected to the free end of the support arm 42 for movement about a vertical axis, which struts at their free ends remote from the frame 10 carry an extension mechanism 48 in the form of a draw spindle assembly. By means of this the leg of a patient lying on his back on the support plate 18 with the counterbar 32 extending through his crotch can be extended. Also, for example in a leg pinning procedure according to Kuntscher, both legs can be extended at the same time, while in the case of a one sided thigh pinning procedure the mechanism can also be used to extend the involved leg while the good leg is supported during the procedure by a Goepel leg holder.

In the case of the operating table according to FIGS. 1 and 2 two triangular, upholstered support plates 50,52 are provided as supplementary devices, which supplement the generally trapezoidally shaped end section 30 to make a rectangular fundamental shape whose width is at least nearly as large as the width of the section 54 of the support plate 18 adjacent to the end section 30. Further two leg support plates 56,58 are shown as additional plates which in their illustrated position of use extend away from the end section 30 of the support plate 18 parallel to one another, and each of which include a support arm 60 (FIG. 2) which extends parallel to the leg support plates 56,58 near the longitudinal middle plane 38 (FIG. 1) of the support plate 18. The supplemental support plates 50,52 as well as the leg support plates 56,58 have, as seen in FIG. 2, uppersides which in the operative positions of the support plates 50,52 and of the leg support plates 56,58 are at least nearly and in the illustrated embodient completely aligned with the upperside of the end section 30 of the support plate 18. These support plates 50,52 and leg support plates 56,58 make possible a careful support of the patient including the hips and legs for the operation; with the extension of at least one leg the two leg support plates 56,58 and at least one of the support plates 50 or 52 is removed so that the operation can be carried out without hinderence. For this reason the supplemental support plates 50,52 and the leg support plates 56,58 are held in an easily removable way, as described hereinafter, on the free forward end of the support arm 42 by a plug-in type connection. In order that during the preparation for the operation an X-ray viewing of the operating field is possible the supplemental support plates 50,52 as well as the leg support plates 56,58 are made to be X-ray transmissible in the same way as the support plate 18 with the exception of their metal support members, for example the support member 60 (FIG. 2.).

The counterbar 32 when inserted is located in a position displaced outwardly from the longitudinal middle plane 38 (FIG. 1.) of the support plate 18. This positioning is achieved through the fact that the free end of the support arm 42 has two vertical receiving openings 64 for the insertable reception of the shaft 34 of the counterbar 32, which openings 64 lie on opposite sides of the longitudinal middle plane 38 of the support plate 18 and with respect to this longitudinal middle plane 38 are displaced outwardly by less than half the largest width of the support plate 18. The counterbar 32 is inserted into one of these vertical receiving openings 64 with its shaft 34 and is displaced a corresponding distance outwardly from the longitudinal middle plane 38. Advantageously the length of this outward displacement is so chosen that the displacement of the center of each vertical opening 64 is between 5 centimeters and 15 centimeters. In the exemplary embodiment this center displacement is 11 centimeters while the largest width of the support plate 18 is about 50 centimeters.

In FIG. 1 the counterbar 32 is displaced toward the left with respect to the longitudinal middle plane 38 as seen from above, that is, with respect to the longitudinal axis of a patient lying on his back on the support plate 18. The left thigh of the patient is therefore displaced outwardly with respect to the longitudinal middle plane 38 of the support plate 18 and therefore is easily accessable to the operating doctor. The support plate 52 is in this case removed and therefore neither hinders the operation nor, with its metal support rod, which is hereinafter described in connection with FIG. 6, hinders the transmission of X-rays in the operating area. Correspondingly in the case of an operation in the area of the right thigh of the patient the counterbar 32 is inserted in the right hand vertical receiving opening 64 and the support plate 50 is removed.

The sidewise displacement of the counterbar 32 with respect to the longitudinal middle plane 38 has the result that in the case of an operation with the patient lying on his side such as in the case of a thigh marrow pinning operation, the counterbar 32 can serve as a groin support for the patient. If need be the counterbar 32 shown in FIG. 1 is pulled out and a longer, but otherwise similar, one 66 is inserted as a groin support. It is therefore not necessary, as in the previously usual way to mount an isolated groin support with an isolated spar for an extension device at the transition between the end section 30 and the adjacent section 54.

On the other hand, if required it is also possible in the case of carrying out a thigh bone synthesizing operation on a patient lying on his side and with a removed counterbar 32 to provide a height adjustable vertical groin support, which at approximately the right height has a horizontal support overlapping the support plate 18 for the upper thigh of the patient. In order that the housing of such height adjustable groin support, which extends downwardly and in which the spindle for the height adjustment is contained, does not limit the range of movement of the spars 44 or 46 so that these hinder the use of a picture forming or other X-ray apparatus, the spars 44,46 of the extension device 48 consist advantageously as in the illustrated embodiment, of two sections 68,70 pivotally connected to one another with the section 68 near the support arm 42 being relatively shorter and the longer section 70 is telescopically adjustable in length in the usual way and is lockable in the desired length in a non-illustrated way. The pivotal joint 72 which connects the sections 68 and 70 for pivotal movement about a vertical axis is lockable in the desired pivotal position by means of a handle 74. The pivotability of the sections 68 and 70 with respect to one another is moreover advantageous in the case of using the operating table for thigh operations and similar procedures in which the patient lies on his back for in this case the spars 44,46 can especially be easily brought to a position in which they do not hinder the use of a picture amplifier or other X-ray apparatus.

As can be recognized from FIG. 1 the vertical receiving openings 64 have a displacement from the forward edge 40 of the end section 32 measured parallel to the longitudinal middle plane 38 of the support plate 18 which is approximately equal to half the thickness of the counterbar 32 in the portion thereof lying above the support plate 18. Further, the end section 30 upstream of the vertical receiving openings 64 relative to its forward side 40 has recesses 80,82 opening away from the sides 76,78 of the end section 30 which recesses in the illustrated example are formed as internal corners and have a cross-section insignificantly larger than the cross-section of the counterbar 32 which section is taken as one in which the counterbar penetrates the support plate. The end section 30 extends therefore in other words in the longitudinal direction so far that its forward side 40 is approximately flush with the side of the counterbar 32 which faces away from the support plate 18. Because of this relatively large longitudinal extent of the end section 30 it is possible, through the use of the counterbar 32 or one of the groin supports 66 to support the pelvis of a patient lying on his side on the end section 30. Only in special cases, perhaps in the case of the use of a laterally added groin support in place of a support plate 50,52 can it be required to provide an isolated pelvic support at the place of the then removed leg support plates 56,58 which in a corresponding way yet to be described are stuck into the free end of the support 42 similar to the leg supports 56,58 and which have the effect of lengthening the end section 30 beyond its forward side 40.

The trapezoidal narrowing of the end section 30 facilitates access to the operation area, especially to the upper part of the leg if during the operation the supplemental support plates 50,52 are removed, and in the illustrated embodiment it is so arranged that the imaginary intersection of the longitudinal sides 76,78 of the end section 30 with the forward side 40 and spaced from the longitudinal middle plane 38 of the support plate 18 by a distance which is approximately as large as the displacement of the middle of one of the vertical receiving openings 64 from the longitudinal middle plane 38 plus the radius of the counterbar 38 in the section thereof which lies above the support plate 18. In this way the already mentioned desired location of the counterbar 32 in one of the inward corner forming recesses 80 or 82 is obtained, which is advantageous with respect to access to the vertical receiving openings 64.

The vertical receiving openings 64 are provided by an adaptor 84 whose construction is hereinafter explained in more detail with respect to FIGS. 3 to 5.

The adaptor 84 comprises two transverse horizontal tube sections 86,88 aligned with one another perpendicular to the longitudinal middle plane 38. In these tube sections 86,88 the vertical receiving openings 64 are formed as bores which extend through the upper and lower walls of the tube section so as to be able to insertably hold the pin 90 of the counterbar 32 whose length is slightly larger than the vertical thickness of the tube sections 86,88. The outwardly directed open mouths of the transversely oriented tube sections 86,88 serve at the same time as receiving openings 92,94 located below the support plate 18 laterally outwardly of the vertical receiving openings 64 and which receiving openings 92,94 are horizontal and of square cross-section and in each of which an auxiliary device such as for example one of the support plates 50 or 52 (FIG. 1) can be insertably held by means of a suitable horizontal pin. To not hinder the transmission of X-rays, on opposite sides the outward displacement of the transversely oriented receiving openings 92,94 advantageously is only slightly greater than the displacement of the receiving openings 64 from the middle plane on opposite sides as in the illustrated example.

The height of the transversely directed receiving openings 92,94 is so chosen that they are positioned between the underside of the support plate 18 and the pivotal joints 96,98 of the spars 44,46 on the support 42; the vertical distance between the centers of the spars 44,46 and the centers of the transversely oriented receiving openings 92,94 is advantageously between 8 centimeters and 15 centimeters or more in order to allow a pivotal movement of the spars 44,46 when using supplemental devices whose horizontal pins are received in the transversely oriented receiving openings 92,94.

The transversely oriented tube sections 86,88 are welded at their inboard ends to the outboard sides of further tube sections 100,102 which extend on opposite sides of the longitudinal middle plane 38 parallel to such plane and therefore parallel to one another in the horizontal direction. Their inner and outer cross-sections are similar to the inner and outer cross-sections of the transversely oriented tube sections 86,88. The longitudinally oriented tube sections 100,102 are approximately aligned at their forward ends with the vertical outer sides of the transversely oriented tube sections 86,86 which face away from the support plate 18 and therefore they are also approximately aligned with the forward side 40 of the support plate end section 30. Further, the longitudinally oriented tube sections 100,102 are open mouthed at their aforesaid open forward ends and form therewith two longitudinally and horizontally directed receiving openings 104,106 at the same height as the transversely oriented receiving openings 92,94.

The longitudinally oriented receiving openings 104,106 serve to insertably receive properly dimensioned, square cross-sectioned horizontal pins of supplemental plates which in their operative position have an upper surface at least approximately aligned with the support plate 18. Such supplemental plates are shown in FIG. 1 and 2 as the leg plates 56,58 which in their operative position extend away from the end section 30 of the support plate 18 parallel to one another and each of which has a support rod 108 (FIG. 2) which extends horizontally and parallelly close to the longitudinal middle plane 38 and terminates in a not further illustrated pin received in one of the longitudinally oriented receiving openings 104,106. Also, as a supplemental plate a pelvic support plate, which has already been mentioned above, can also be provided which when inserted laterally into one of the transversely oriented receiving openings 92,94 serves as a pelvic support for lengthening the end section 30 and which can also have two horizontal pins for insertion into the longitudinally directed receiving openings 104,106.

Figure 3:
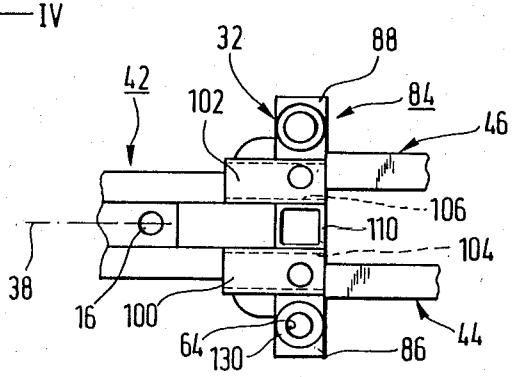
FIG. 3 is a plan view of the end area of the support arm of the operating table of FIGS. 1 and 2 with the end portion of the support plate being cut away.
Figure 5:
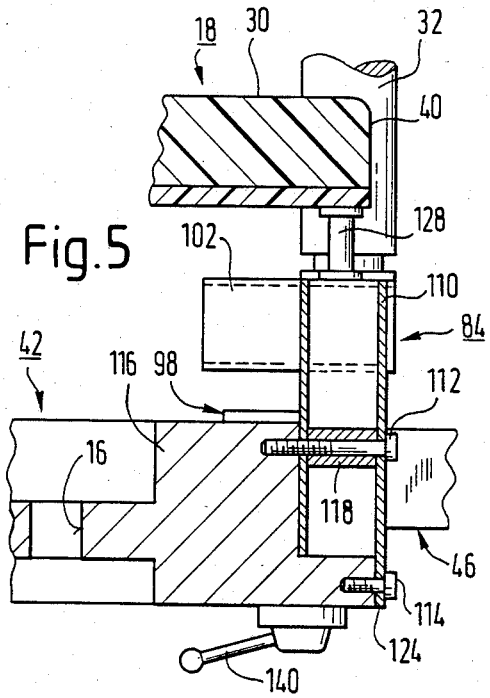
FIG. 5 is a partial longitudinal section through the operating table along the line V—V of FIG. 1.

The longitudinally oriented tube sections 100,102 have for the reception of the aforenamed pins properly dimensioned lengths and extend, as seen in FIG. 3 and 5, with their ends which face toward the support plate 18 beyond the corresponding vertical side of the transversely oriented tube sections 86,88. The spacing between the centers of the longitudinally oriented receiving openings 104,106 provided by the longitudinally oriented tube sections 100,102 is relatively small and should in any event be smaller than the spacing between the vertical receiving openings 64. In the illustrated example the spacing between the centers of the longitudinally oriented receiving openings 104,106 is about 10 centimeters. By means of this small center spacing and the corresponding small spacing between the support rod 108 of the leg support plate 56,58 easy X-ray transmissibility through the leg support plate is obtained.

The vertical sides of the longitudinally oriented tube sections 100,102 which face each other are welded in the areas thereof which are aligned with the transversely oriented tube sections 86,88 to an intermediate member made from a vertical tube section 110 having a square cross-section similar to that of the tube sections 86,88, 100 and 102, which intermediate member 110 extends from the height of the common upper sides of the tube sections 86,88, 100,102 downwardly to the free end of the support arm 42 to which it is fastened by means of screws 112,114. Therefore the adaptor 84 in total has generally the shape of an upstanding T.

Figure 4:
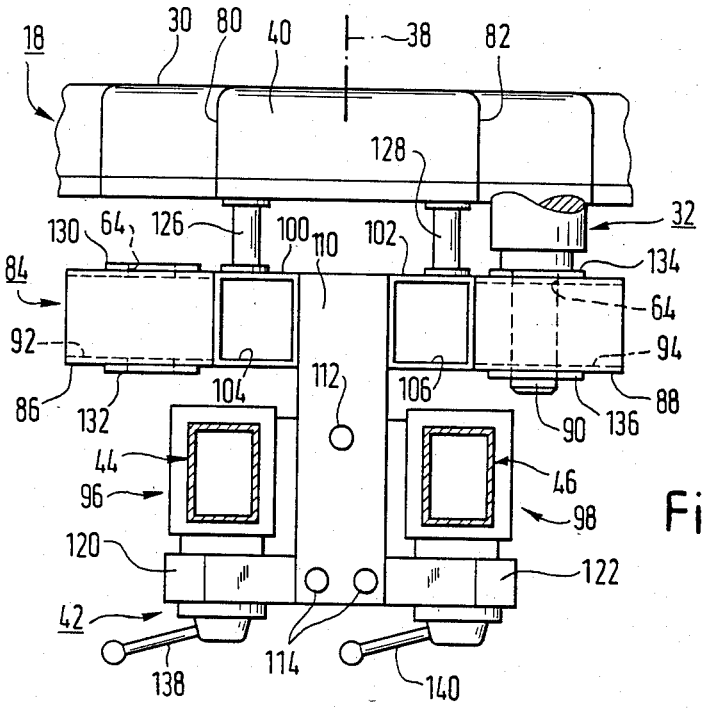
FIG. 4 is a partial forward elevational view of the operating table taken on the lines IV—IV in FIG. 2.

The free end of the support arm 42 is, as especially evident from FIG. 4 and 5, shaped in cross-section like an inverted T. It has in this case a middle portion 116 which extends along the longitudinal middle plane 38 and to the forward side of which, which faces away from the support plate 18, the vertical tube section 110 is fastened by the screw 112. The latter screw extends through both walls of the vertical tube section 110 and in the interior of the tube section 110 is surrounded by a sleeve 118 which prevents compression of the tube section 110. Further, the end of the support arm 42 has on both sides of its middle portion 116 two lower flanges 120,122 extending transversely outwardly which like the middle portion 116 extend a small distance in the longitudinal direction. The wall of the vertical tube section 110 which faces away from the support plate 18 at its lower end forms a flange 124 which is fastened to the middle portion 116 in the area which overlaps the length direction of the flanges 120,122. In this way the adaptor 84 is very stiffly connectd to the free end of the support arm 42 which, for example in the case of the bending moment applied to the adaptor 84 by the leg support plates 56,58, is important. The upper side of the adaptor 84 is moreover connected to the end section 30 of the support plate 18 by columns 126,128 whereby the bending stiffness is further increased and the end section 30 is additionally supported in the vertical direction. For increasing the rigidity of the transversely oriented tube sections 86,88 with respect to the bending moment applied to the counterbar 32 the upper and lower sides of the transversely oriented tube sections 86,88 are strengthened in the vacinity of the vertical receiving openings 64 by metal rings 130,132 and 134,136 welded to the tube sections 86,88.

The pivot joints 96,98 by means of which the spars 44,46 are pivotally connected to the free ends of the support arm 42 are arranged on opposite sides of the longitudinal middle plane 38 in similar displacements from such plane, and indeed are located on opposite sides the middle portion 116 and of the vertical tube section 110 on the upper sides of the flanges 120,122. They can be locked in the desired position by means of handles 138,140. Since the pivot joints 96,98 are located below the end section 30 without overlapping the forward side 40 of the end section 30 in the longitudinal direction, by proper pivotal movement of the spars 44,46 transmission of X-rays can be had from a remote point up to the forward side 40 of the end section 30 without the pivot joints 96,98, the spars 44,46 or the adaptor 84 causing any interference.

Figure 6:
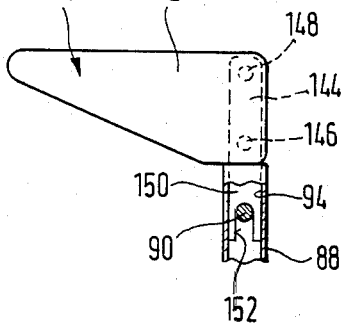
FIG. 6 is a plan view of one of the supplementary support plates used with the operating table of FIG. 1.

In FIG. 6 the construction of the triangular supplemental support plate 52 is illustrated in more detail; the support plate 50 is of a corresponding mirror immage construction. The support plate 52 has an X-ray transmissible upholstered horizontal upper portion 142 a horizontal support rod 144 lying below the upper portion 142, vertical pins 146,148 which connect the upper portion 142 to the support rod 144 and a horizontal pin 150 of square cross-section which is formed as an extension of the support rod 144 and in plan view extends outwardly from the upper portion 142. In order to bring the support plate into its operative position laterally of the end section 30 (FIG. 1) the pin 150 is inserted into the transversely oriented receiving opening 94 of the transversely oriented tube section 88. The pin 90 of the counterbar 32 and accordingly the bore which forms the vertical receiving opening 64 (FIG. 4) have a width measured in the horizontal direction which is smaller than the width of the transversely oriented tube section 88, and the pin 150 whose length is larger than the length of the tube section 88 between its mouth and the penetrating vertical receiving opening 64 has an open end forming a vertical slot-shaped recess 152 whose width is at least as large as the width of the pin 90 and of the vertical receiving opening 64. Therefore, it is possible despite the presence of an inserted counterbar 32 to attach or remove the support plate 52 and likewise the counterbar 32 or the groin support 66 (FIG. 2) can be inserted or removed regardless of whether the support plate 52 is mounted or not.

With respect to supplemental devices, replacing the support plates 50,52 and which are attached by horizontal pins insertable in the transversely oriented receiving openings 92,94, in order to assure that their pins are not capable of being pushed out of the transversely oriented receiving openings 92,94 upon the removal of the counterbar 32 an advantageous departure from the construction of the support plates 50,52 can consist of providing the pins with a vertical bore which when the pin is inserted into one of the transversely oriented receiving openings 92,94 aligns with the associated one of the receiving openings 64 thereby allowing a bolt to be inserted which passes through the receiving opening 64 and the aforesaid bore of the pin in order to lock the latter in place. This construction is especially advantageous in special cases where in place of a support plate 50,52 a laterally brought in groin support is used.

We claim:

1. An operating table for operations on the extended extremities of patients, said table comprising a frame, a support plate for the upper body of the patient arranged on said frame, which support plate has an end section usable to support the pelvis of the patient, a support arm provided on said frame below said support plate and which arm extends along the longitudinal middle plane of said support plate and has a free forward end located below the forward side of said end section, said free forward end of said support arm having two vertical counterbar receiving openings located on opposite sides of the longitudinal middle plane of said support plate and each of which openings is displaced outwardly from said middle plane by less than half the largest width of said support plate, and a counterbar adapted to be removably inserted in either one of said two vertical counterbar receiving openings of said arm and which counterbar when so inserted extends vertically upwardly beyond the top surface of said support plate, said counterbar receiving openings being located near said forward side of said end section so that when said counterbar is inserted in either one of said counterbar receiving openings it is engageable with the pelvic area of a patient lying with his upper body on said support plate, said support plate having an end section of trapezoidal shape which tapers to its forward side, said free end of said support arm also having means providing two horizontally directed aligned receiving openings extending in opposite directions transversely to said longitudinal middle plane of said support plate and having identical non-circular cross-sections, and two supplemental devices each insertably fastenable in one of said transversely extending receiving openings by means of a horizontal pin on said supplemental device, each of said supplemental device being in the form of a triangular support plate, said two devices when their pins are inserted in said transversely oriented receiving openings being arranged so that said trapezoidally shaped end section is enlarged by said triangular support plates to at least approximately a rectangular form whose width is at least approximately as large as the width of the section of said support plate adjacent to said end section.

* * * * *